US010967947B1

(12) United States Patent
McIntyre, II

(10) Patent No.: US 10,967,947 B1
(45) Date of Patent: Apr. 6, 2021

(54) AIRBOAT TRIM APPARATUS AND METHOD

(71) Applicant: Marine Turbine Technologies, LLC, Franklin, LA (US)

(72) Inventor: Ted Lee McIntyre, II, New Iberia, LA (US)

(73) Assignee: Marine Turbine Technologies, LLC, Franklin, LA (US)

( * ) Notice: Subject to any disclaimer, the term of this patent is extended or adjusted under 35 U.S.C. 154(b) by 100 days.

(21) Appl. No.: 16/437,340

(22) Filed: Jun. 11, 2019

(51) Int. Cl.
*B63H 21/30* (2006.01)
*B63H 21/16* (2006.01)
*B63H 7/02* (2006.01)

(52) U.S. Cl.
CPC ..... *B63H 21/30* (2013.01); *B63H 7/02* (2013.01); *B63H 21/16* (2013.01); *B63H 2021/307* (2013.01)

(58) Field of Classification Search
CPC ..... B63H 21/30; B63H 21/16; B63H 7/02; B63H 2021/307
See application file for complete search history.

(56) References Cited

U.S. PATENT DOCUMENTS 3,467,214 A * 9/1969 Wheatley ..... B60V 1/043 180/127
3,495,679 A * 2/1970 Cockerell ..... B60V 1/02 180/118
5,082,465 A * 1/1992 Wine ..... B63H 7/02 416/189
5,096,012 A * 3/1992 Chia ..... B60V 1/14 180/117
5,370,197 A * 12/1994 Goodwin ..... B60V 1/043 180/117
5,522,470 A * 6/1996 Stiegler ..... B60V 1/11 114/67 A
6,468,119 B1 * 10/2002 Hasl ..... B63H 5/125 440/57

(Continued)

FOREIGN PATENT DOCUMENTS

GB 946917 A 1/1964
GB 2068310 A 8/1981
RU 2256569 C1 7/2005

OTHER PUBLICATIONS

Vanair Hovercraft, "Vanguard 18 Specs & Performance Data", http://www.vanairhovercraft.com/v18.htm, Date Unknown, Downloaded Jun. 4, 2019 (3 pp).

*Primary Examiner* — S. Joseph Morano
*Assistant Examiner* — Jovon E Hayes
(74) *Attorney, Agent, or Firm* — Young Basile Hanlon & MacFarlane, P.C.

(57) ABSTRACT

A trim system for an airboat having a hull and a deck comprises an engine support carriage elevated from the deck and having a first end pivotably mounted to the deck via a rigid frame, and at least one remotely operated hydraulic ram with each including a first end braced upon the deck or an intervening structure and a second end coupled to a free moving second end of the engine support carriage opposite the first end. In a method of adjusting trim on an airboat, during operation of an engine mounted to the engine support carriage, a thrust line of the engine is selectively changed by remotely causing the at least one linearly actuated lift to selectively extend and retract.

27 Claims, 16 Drawing Sheets

(56) References Cited

U.S. PATENT DOCUMENTS

| | | | | |
|---|---|---|---|---|
| 6,468,120 | B1 * | 10/2002 | Hasl | B63H 20/10 440/53 |
| 6,892,666 | B1 * | 5/2005 | Plante | B63B 39/005 114/363 |
| 7,428,939 | B1 * | 9/2008 | Ducote | B60V 1/043 180/116 |
| 8,187,045 | B2 * | 5/2012 | Thibodaux | B63B 35/00 440/37 |
| 8,262,423 | B2 | 9/2012 | Thibodaux | |
| 8,348,708 | B2 | 1/2013 | Kanerva | |
| 8,991,540 | B2 * | 3/2015 | Mercier | B60V 1/11 180/117 |
| 9,108,612 | B2 * | 8/2015 | Gregory | B60V 1/043 |
| 2006/0113425 | A1 * | 6/2006 | Rader | B64C 15/00 244/17.11 |

* cited by examiner

AIRBOAT TRIM APPARATUS AND METHOD

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The field of endeavor concerns operator-adjustable pitch trim systems for airboats.

2. Description of the Related Art

An airboat is a boat that is driven by a propeller that pushes air behind the boat. This differs from conventional boats, where a propeller is submerged in the water behind or beneath the boat. Omitting the water propeller minimizes draught and drag and enables airboats to travel over a variety of shallow terrain such as water, marsh, estuaries, mud, sand, and grass.

An airboat tends to run best when its hull attitude is similar to its hull attitude at rest. However, when an airboat is underway, various factors change the hull attitude, such as loading, water conditions, center of buoyancy, and whether the boat is plowing or planing. It is important to reach an optimum hull attitude because this minimizes drag and therefore maximizes speed and efficiency. Having the optimum hull attitude also maximizes controllability and therefore safety. If the bow is too low, for example, it can be difficult to steer. If the bow is too high, this can cause the hull to pound the water when traversing waves.

For these reasons, most airboats include some type of trim system to adjust the bow upward or downward when the airboat is underway. Typically, the trim system involves a trim tab that is pivotably coupled to the transom. In some cases, the trim tab has an operator controlled device that moves the free end of the trim tab up and down. When the trim tab exerts downward force against water behind the boat, this helps pitch the bow downward toward the water.

For many people, this trim tab design is completely satisfactory. However, a new breed of airboat is becoming increasingly popular. These airboats use gas turbine engines instead of reciprocating auto or boat engines. Turbine driven airboats produce a massive amount of horsepower and can accommodate a huge load. The Assignee manufactures a twin turbine powered airboat, which greatly expands and amplifies the power and capabilities of airboats. These high power airboats, however, call for a correspondingly powerful trim system.

One design choice would be to manufacture larger trim tabs. Indeed, due to the likely size of such trim tabs as would be required for turbine applications, the resulting trim table could potentially be huge. However, the present inventors recognized that the large trim tab size might require additional complexities such as a mechanical system dedicated to actuating the trim tabs. The inventors also recognized that the enlarged trim tabs might be so large that they would be awkward, "in the way," or vulnerable to damage.

Therefore, a particular problem confronting the present inventors has been to design an airboat pitch trim system that is suitable for a massive horsepower airboat such as turbine powered airboat, and avoids the limitations that traditional tab-based trim systems would introduce to massive horsepower systems.

SUMMARY OF THE INVENTION

One aspect of the disclosure is a trim system for an airboat having a hull and a deck. The system comprises an engine support carriage elevated from the deck and having a first end pivotably mounted to the deck via a rigid frame, and at least one remotely operated hydraulic ram with each including a first end braced upon the deck or an intervening structure and a second end coupled to a free moving second end of the engine support carriage opposite the first end.

Another aspect of the disclosure is a method of adjusting trim on an airboat. During operation of an engine mounted to the engine support carriage, a thrust line of the engine is selectively changed by remotely causing the at least one linearly actuated lift to selectively extend and retract.

TABLE 1

INDEX OF NUMERIC REFERENCES

Figure 1:
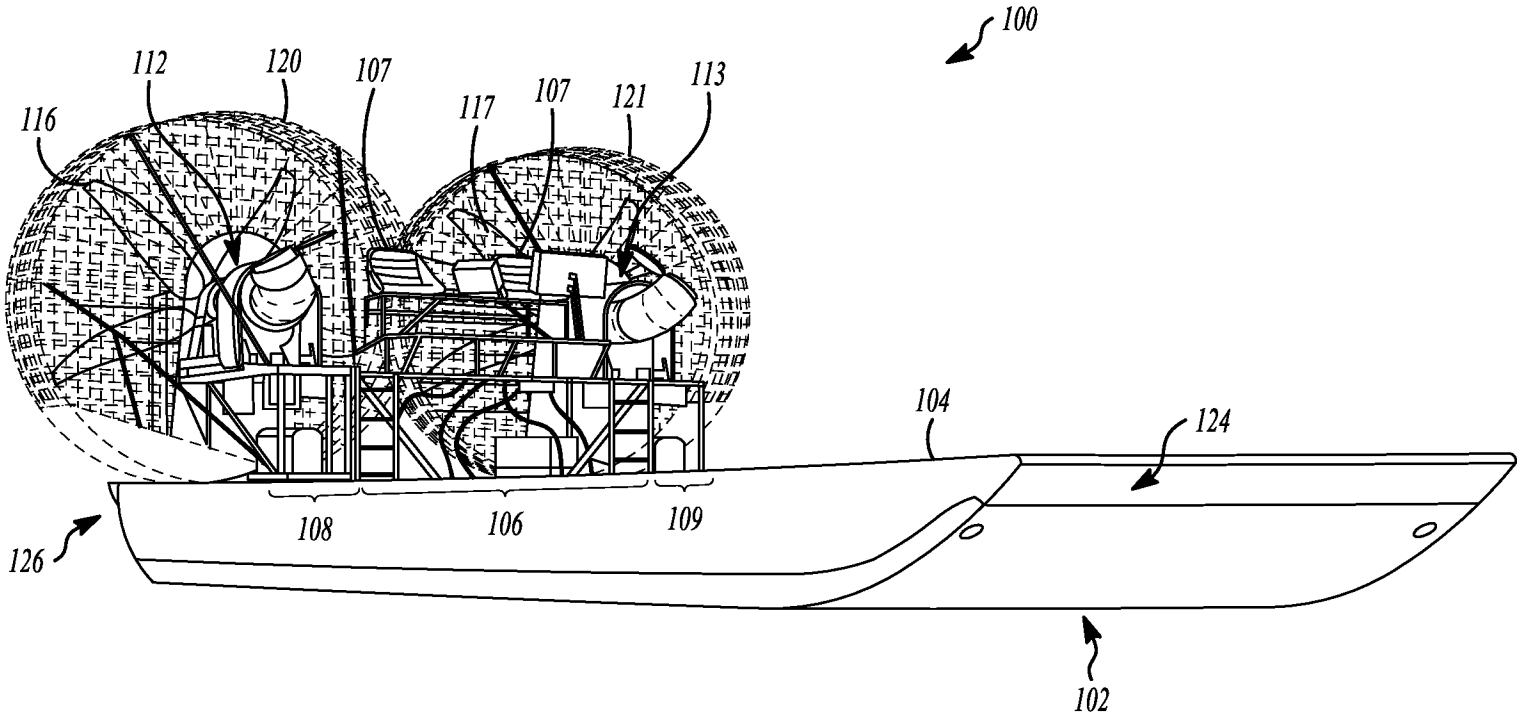
FIG. 1 is a first perspective view of an airboat.

| FIG. | REFERENCE | NAME |
|---|---|---|
| FIG. 1 | 100 | massive horsepower airboat |
| | 102 | hull |
| | 104 | deck |
| | 106 | seating structure |
| | 107 | seats |
| | 108 | engine support structure (starboard) |

TABLE 1-continued

Figure 2:
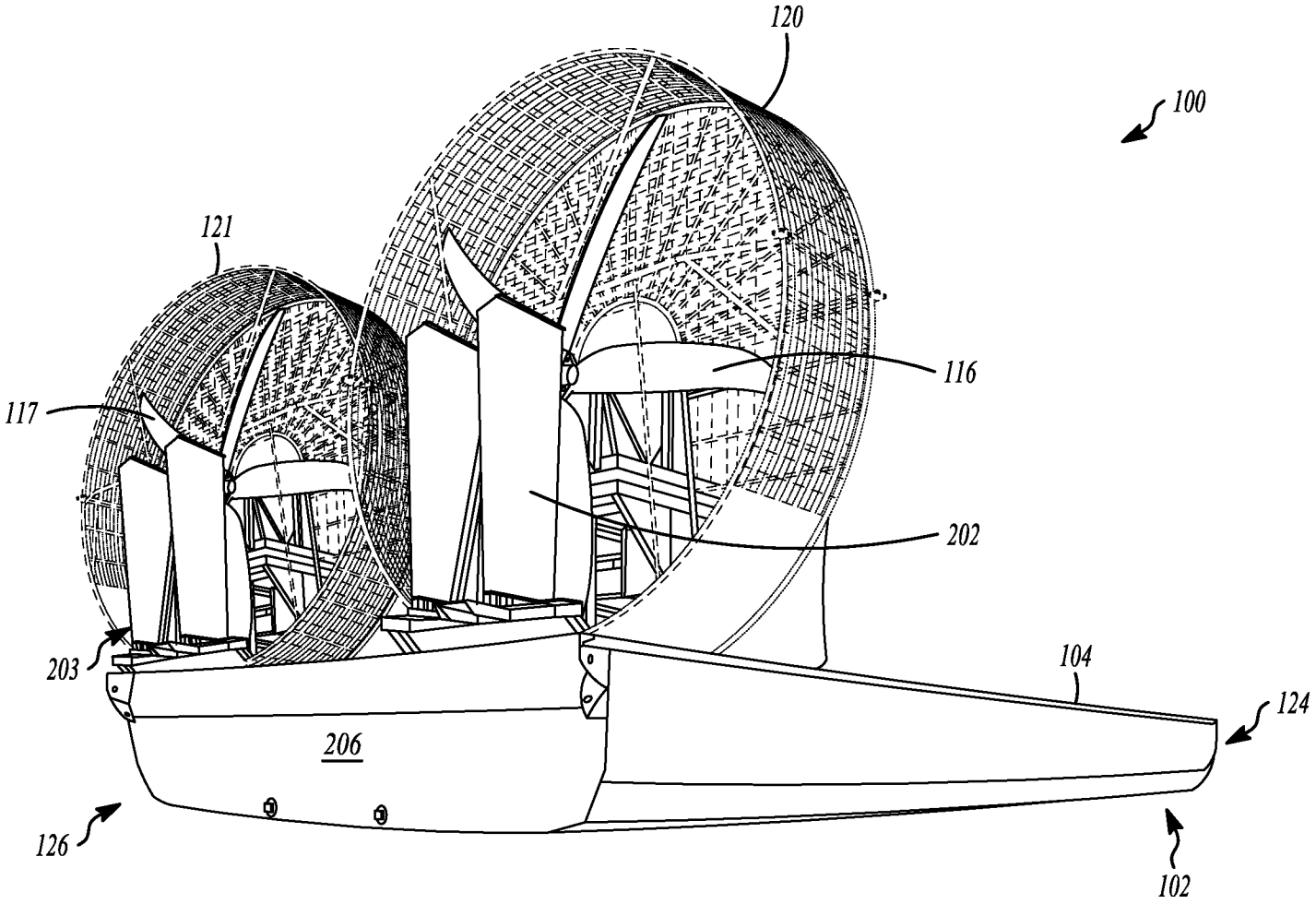
FIG. 2 is a second perspective view of an airboat.
Figure 7:
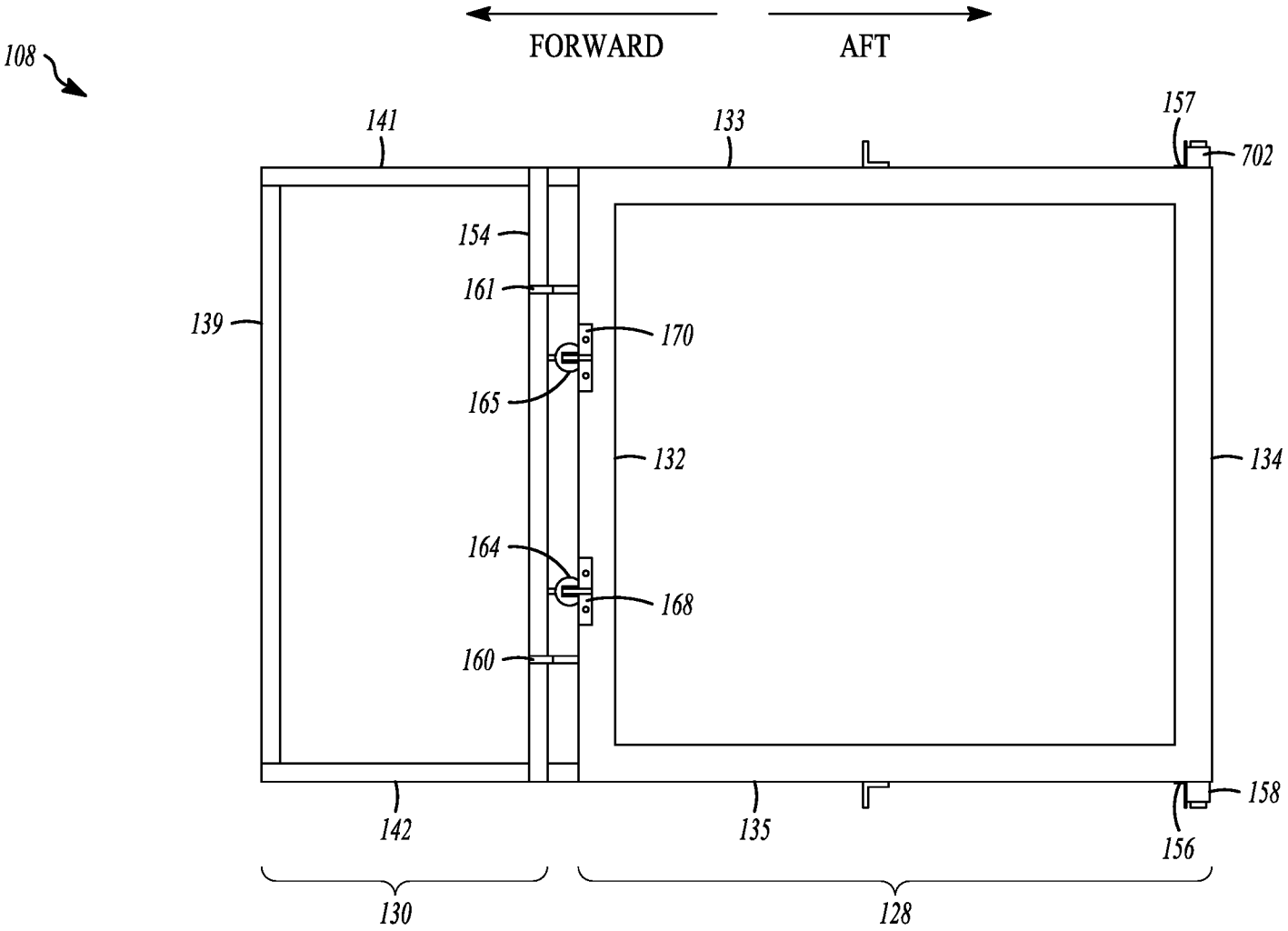
FIG. 7 is a top plan view of an engine support structure in a retracted position.
Figure 8:
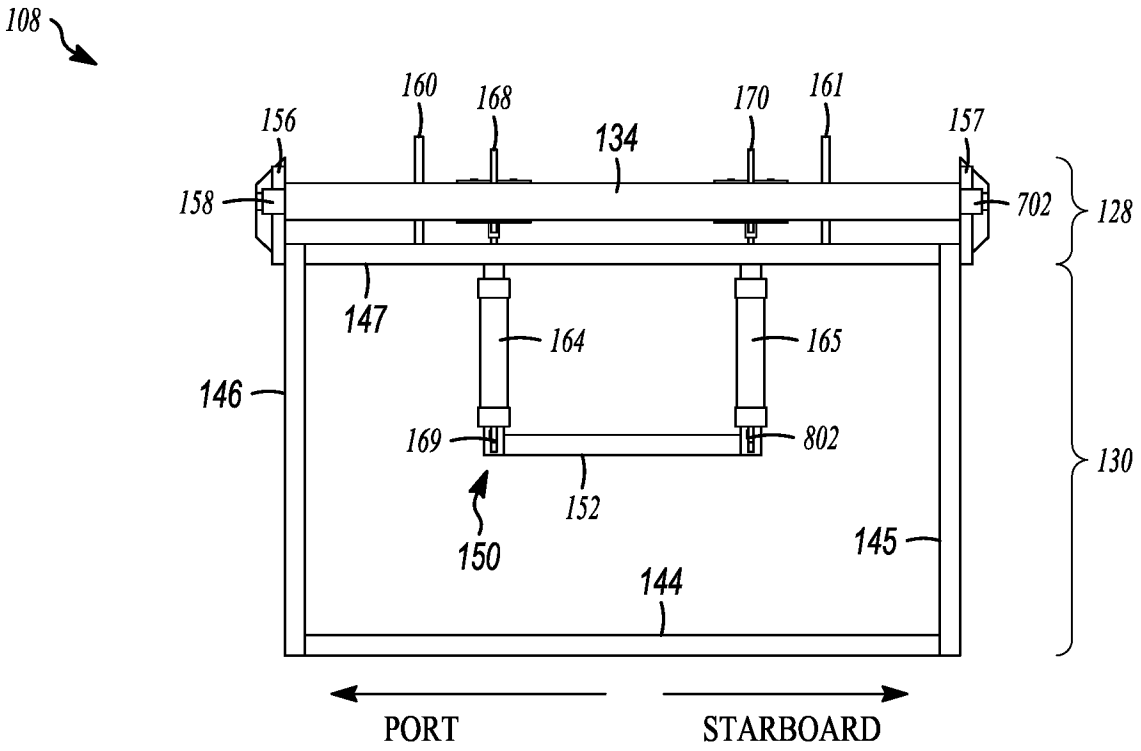
FIG. 8 is a rear plan view of an engine support structure in a retracted position.
Figure 9:
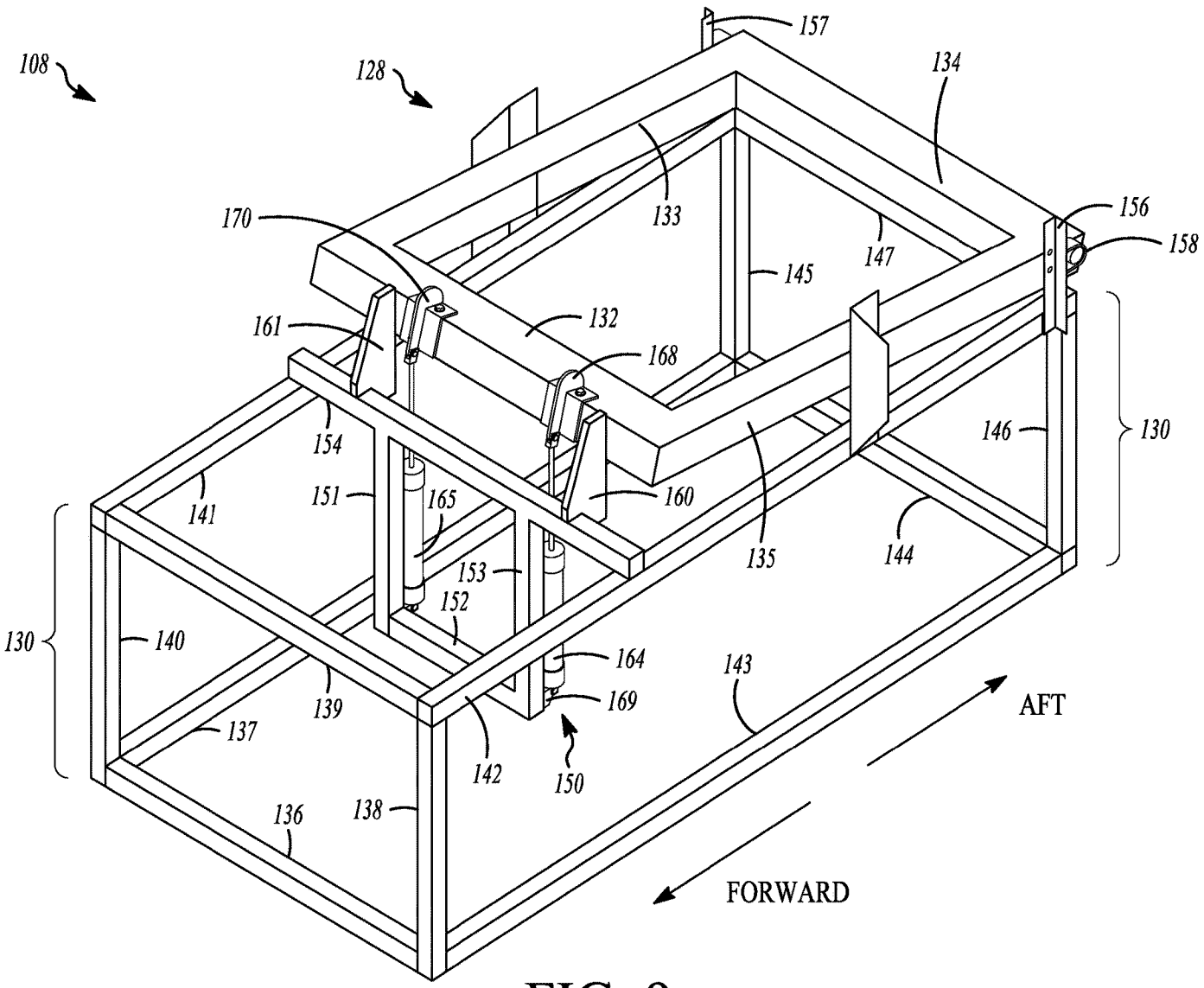
FIG. 9 is a perspective view of an engine support structure in an extended position.
Figure 10:
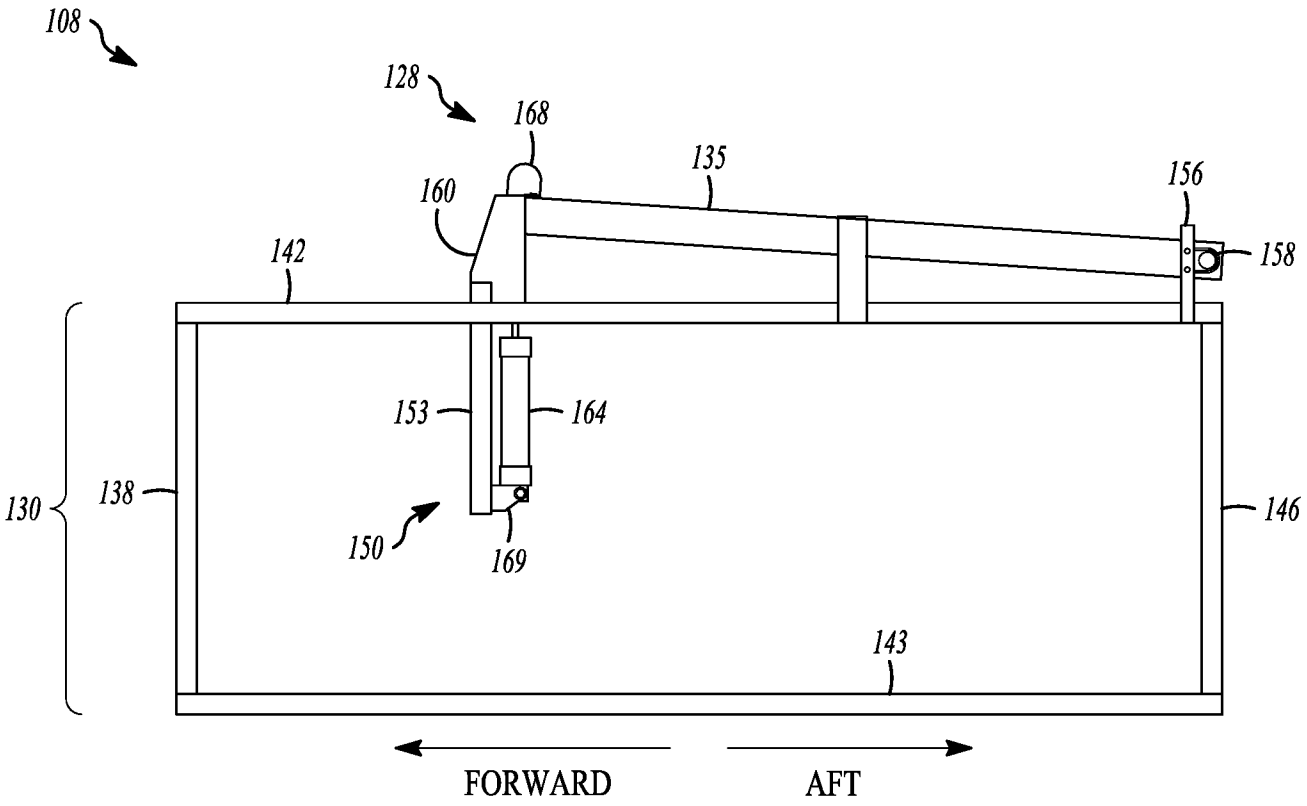
FIG. 10 is a side plan view of an engine support structure in an extended position.
Figure 11:
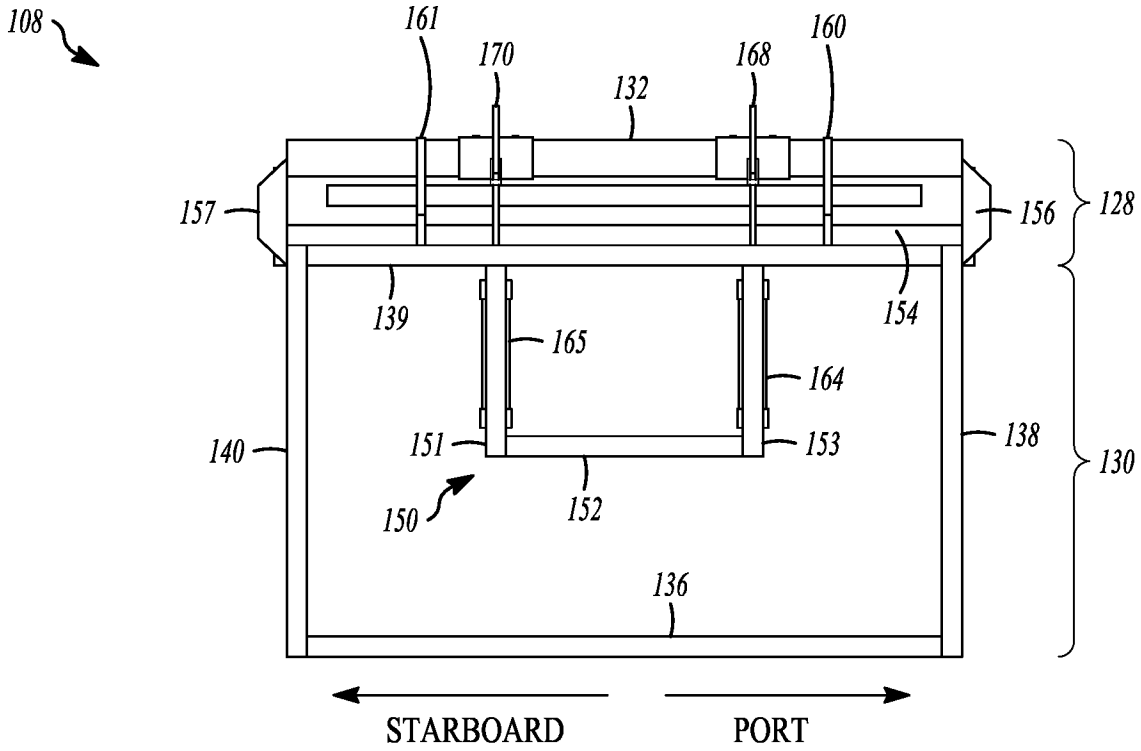
FIG. 11 is a front plan view of an engine support structure in an extended position.
Figure 12:
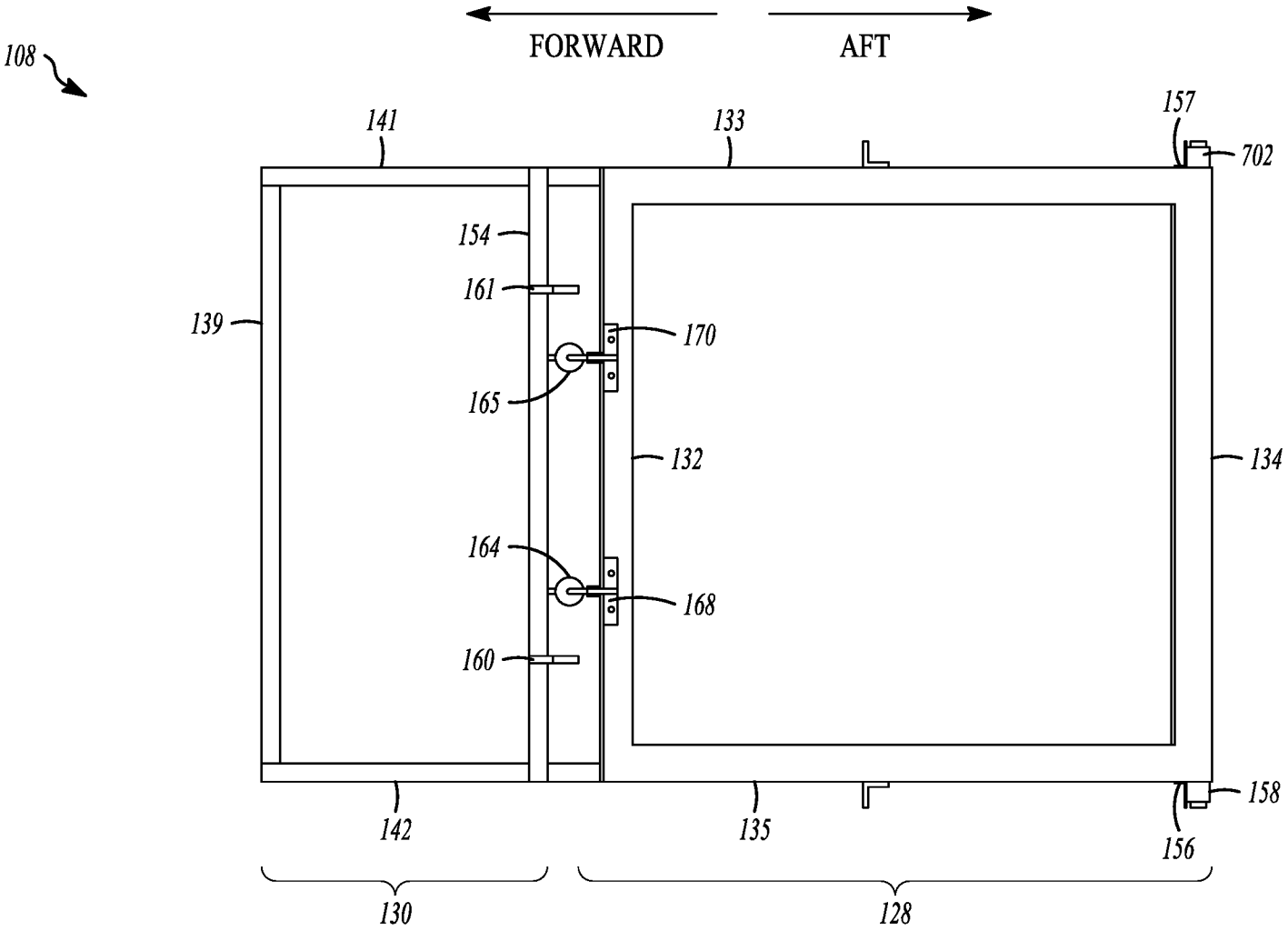
FIG. 12 is a top plan view of an engine support structure in an extended position.
Figure 13:
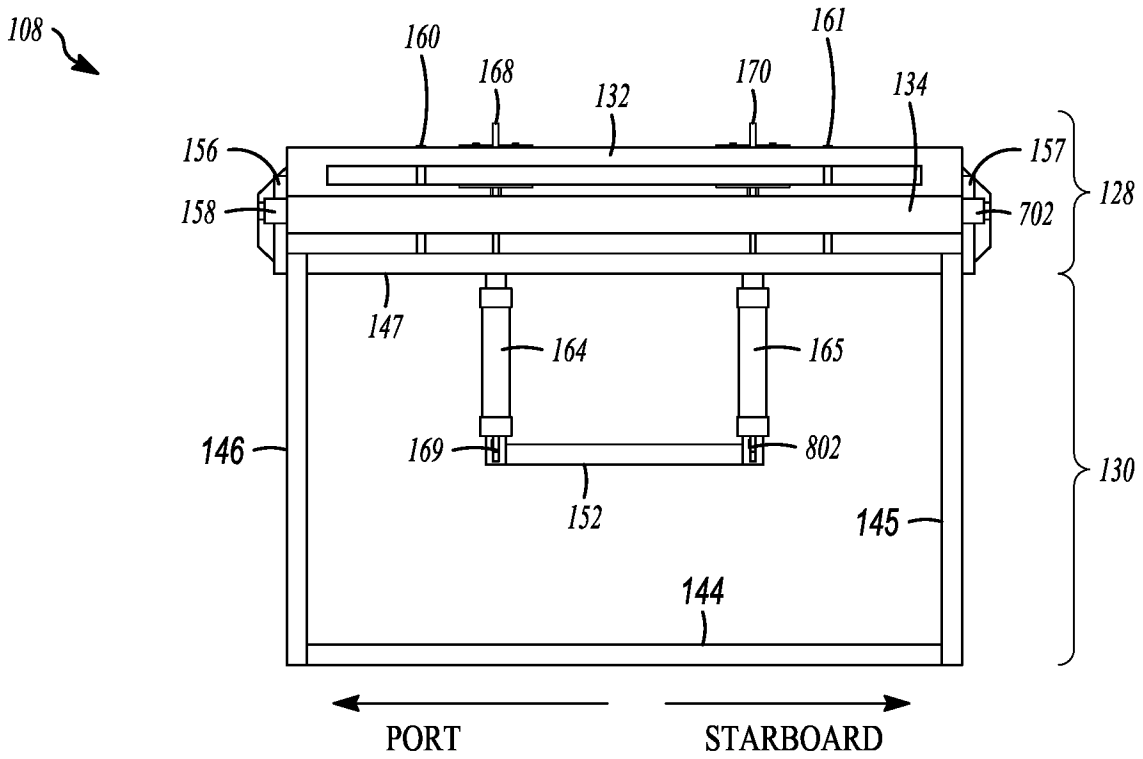
FIG. 13 is a rear plan view of an engine support structure in an extended position.
Figure 14:
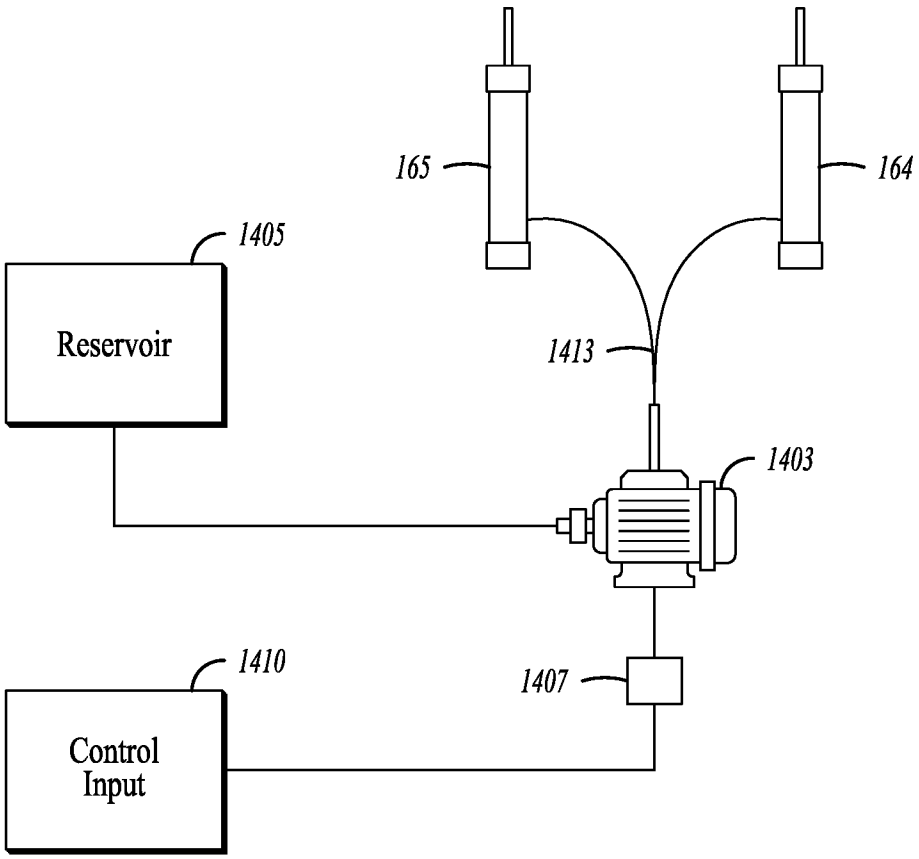
FIG. 14 is a schematic diagram of a hydraulically driven carriage control system.
Figure 15:
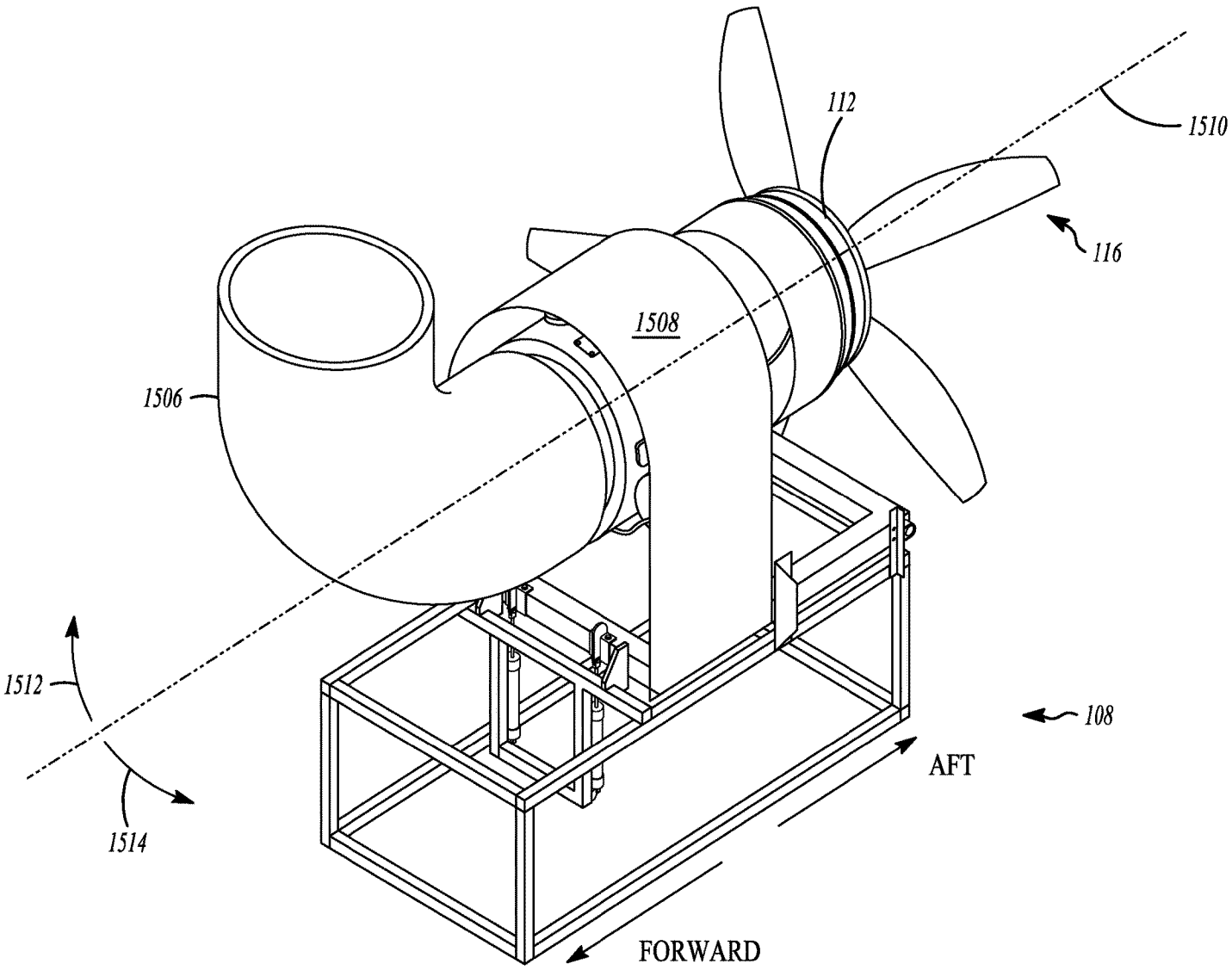
FIG. 15 is a perspective view of a gas turbine engine mounted to an engine support structure.

| INDEX OF NUMERIC REFERENCES | | |
|---|---|---|
| FIG. | REFERENCE | NAME |
| | 109 | engine support structure (port) |
| | 112 | engine (starboard) |
| | 113 | engine (port) |
| | 116 | propeller (starboard) |
| | 117 | propeller (port) |
| | 120 | cage (starboard) |
| | 121 | cage (port) |
| | 124 | bow |
| | 126 | stern |
| | 128 | carriage |
| | 130 | frame |
| | 132-135 | carriage sections |
| | 136-147 | frame sections |
| | 150 | brace |
| | 151-154 | brace sections |
| | 156-157 | extensions |
| | 158 | bearing |
| | 160-161 | catches |
| | 164-165 | hydraulic rams |
| | 168-170 | brackets |
| FIG. 2 | 202 | air rudders (starboard) |
| | 203 | air rudders (port) |
| | 206 | transom |
| FIG. 7 | 702 | bearing |
| FIG. 8 | 802 | bracket |
| FIG. 14 | 1403 | pump |
| | 1405 | reservoir |
| | 1407 | actuator |
| | 1410 | control input |
| | 1413 | supply line |
| FIG. 15 | 1506 | exhaust |
| | 1508 | shroud |
| | 1510 | thrust line |
| | 1512 | extension |
| | 1514 | retraction |

DETAILED DESCRIPTION

The nature, objectives, and advantages of the invention will become more apparent to those skilled in the art after considering the following detailed description in connection with the accompanying drawings.

HARDWARE COMPONENTS AND INTERCONNECTIONS

Airboat Layout

The present disclosure relates to an adjustable trim system and related method for an airboat. For ease of reference, without any intended limitation, this system may be referenced by various names, such as a trim system, trim apparatus, trim method, pitch control system, etc. Broadly, this system provides an improved apparatus and method to adjust engine trim "on the fly" aboard a massive horsepower airboat such as a twin turbine airboat.

Figure 3:
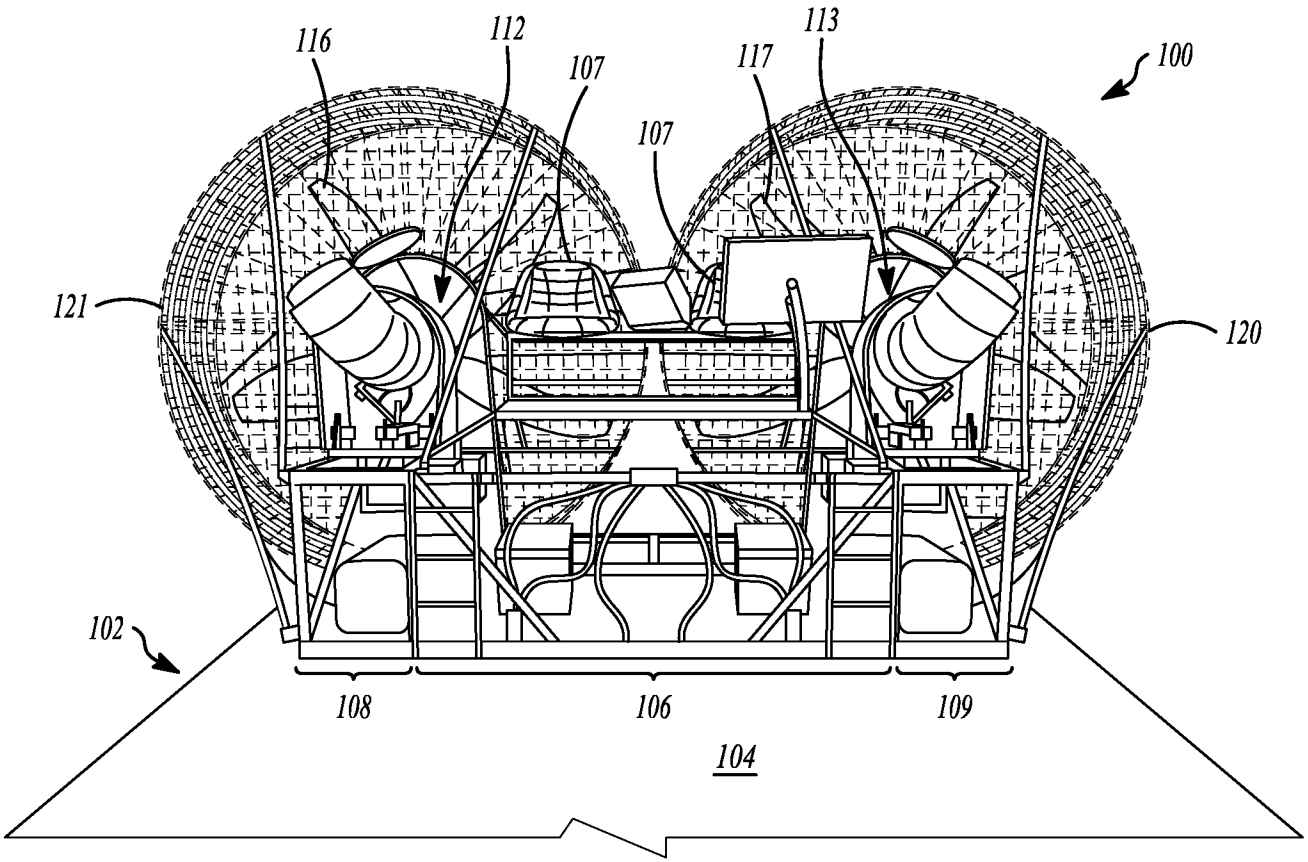
FIG. 3 is a partial third perspective view of an airboat.
Figure 4:
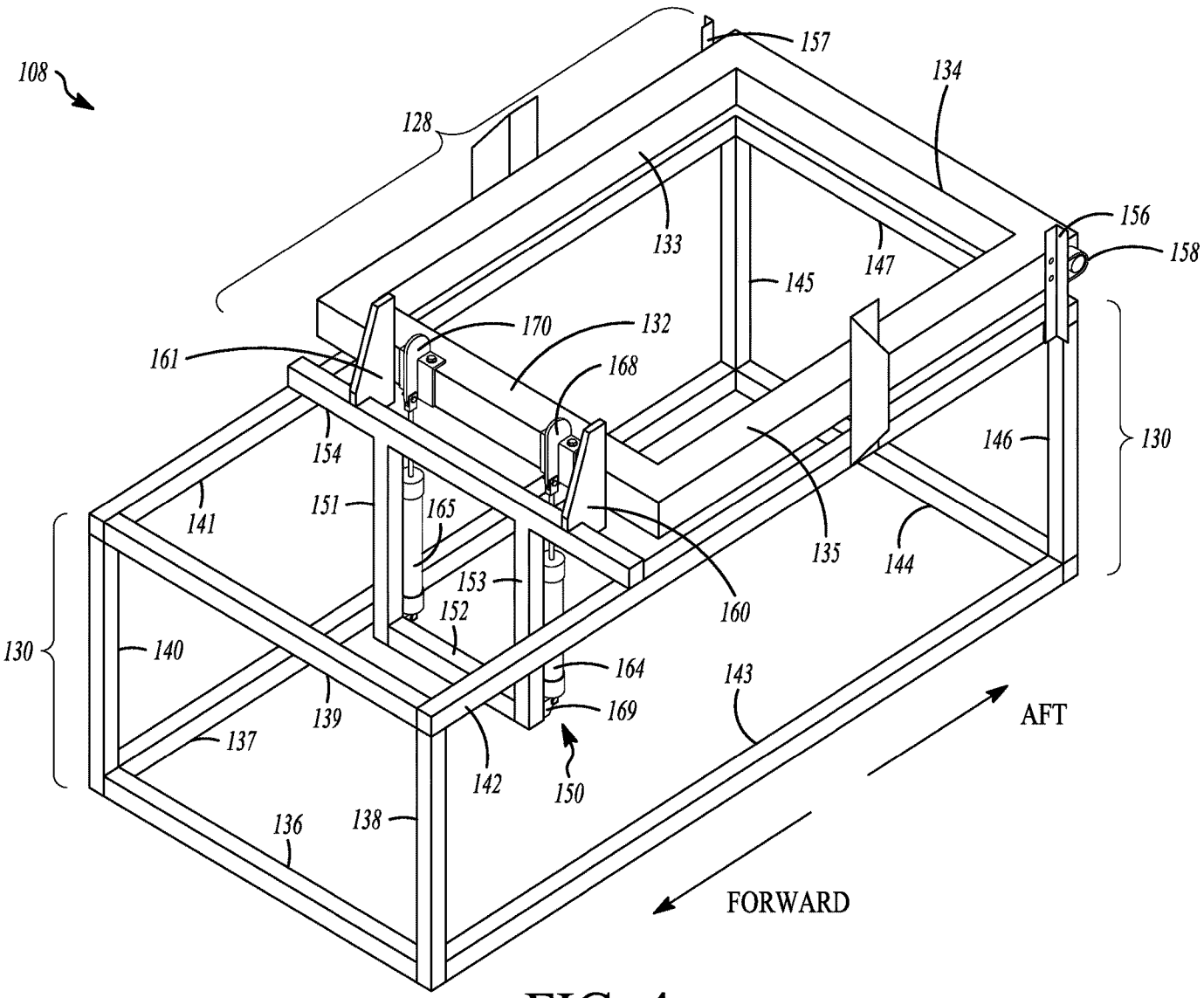
FIG. 4 is a perspective view of an engine support structure in a retracted position.
Figure 5:
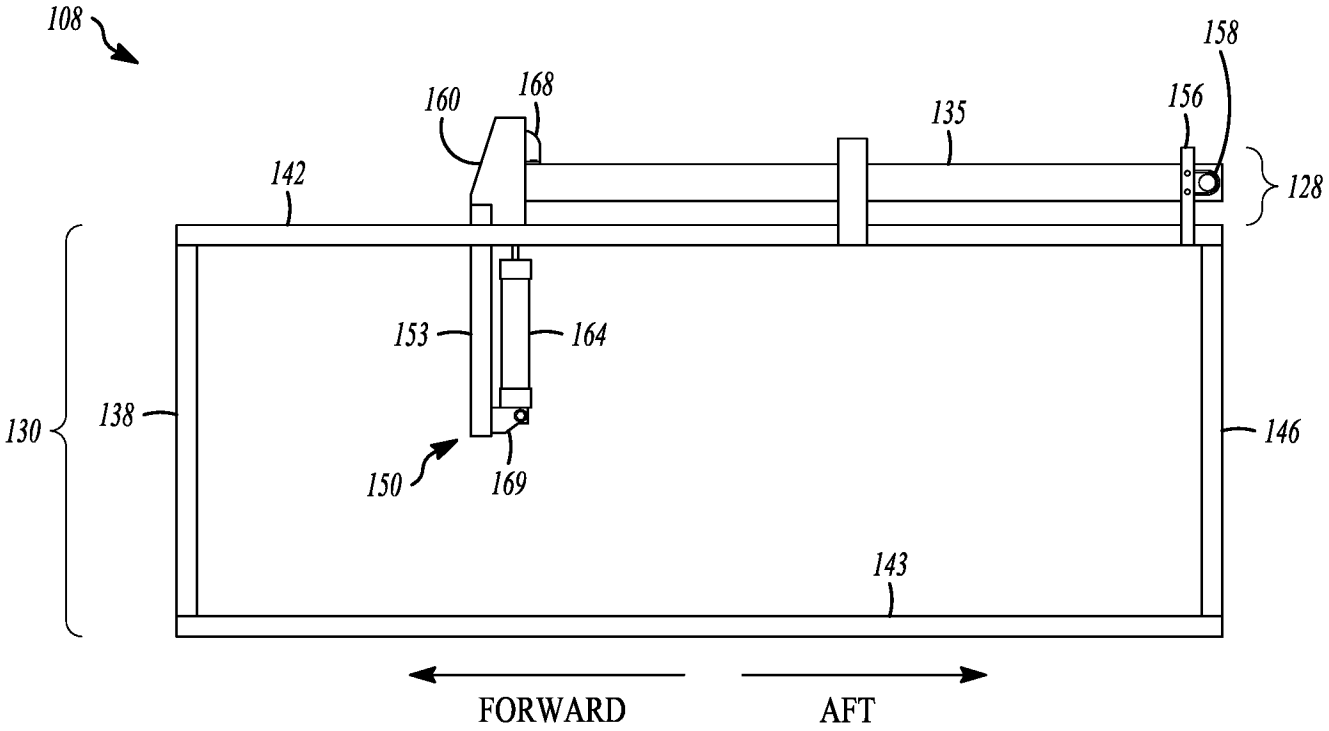
FIG. 5 is a side plan view of an engine support structure in a retracted position.
Figure 6:
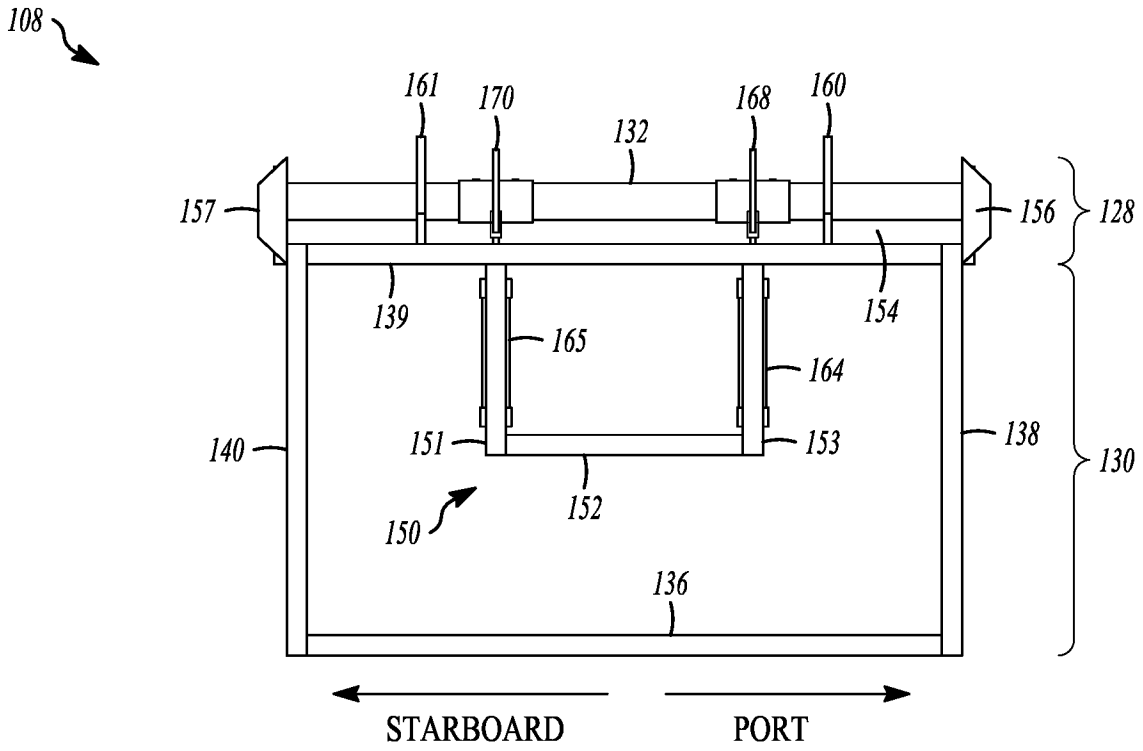
FIG. 6 is a front plan view of an engine support structure in a retracted position.

FIGS. 1-3 depict an exemplary massive horsepower airboat 100, which in this case is driven by a pair of turboshaft gas turbine engines. The airboat 100 includes a low draft hull 102, which in this example includes a flat deck 104. The airboat 100 has a bow 124 and stern 126. The stern 126 includes a transom 206.

The deck 104 supports a seating structure 106 as well as starboard side 108 and port side 109 engine support structures. The seating structure 106 includes seats 107 for the operator and one or more passengers, as well as displays and controls for use in operating the airboat and its engines. Gas turbine engines 112-113 are mounted to the engine support structures 108-109.

The engines 112-113 drive propellers 116-117. The propellers are housed in protective cages 120-121. Aft of the cages 120-121 there are two sets of twin air rudders 202-203, each set corresponding to one of the engines 112-113. The air rudders 202-203 swing laterally to port and starboard under control of a lever near the operator's seat 107.

Engine Support Structure

A basic duty of the engine support structures 108-109 is to provide a solid foundation for mounting for the engines 112-113. Mounting must be above the deck 104 with sufficient height that the propellers 116-117 can rotate free of the deck 104 and transom 206. Also important, from the standpoint of the present disclosure, is that the engine support structures 108-109 fulfill the novel duty of adjusting pitch trim for the airboat 100. Indeed, rather than using a water-contacting device such as trim tabs, the present disclosure addresses the issue of pitch trim in a completely different way, and namely, by adjusting the angle of incidence of the engines 112-113.

Engine Support Structure—Detail in Retraction

Representative of both engine support structures 108-109 in retracted condition, FIGS. 4-8 illustrate the starboard side engine support structure 108 in greater detail. The components are similar in the port side engine support structure 109. The structure 108 includes an engine support carriage 128, a frame 130, and various interconnecting hardware. The frame 130 supports the carriage 128, the carriage 128 supports a mounting fixture (not shown), and the mounting fixture supports the engine 112.

The carriage 128 is shaped, sized, and positioned appropriately to support a gas turbine engine. In the illustrated example, the carriage 128 includes rectangular steel tubing sections 132-135 welded together. However, different shapes and material and fastening means may be used without departing from this disclosure. Many of these will be apparent to ordinarily skilled artisans having the benefit of this disclosure.

The frame 130 is shaped, sized, and positioned appropriately to support the carriage 128 in an elevated position above the deck 104. The frame 130 and carriage 128 give the engine 112 and propeller 116 sufficient height above the deck 104 to rotate freely of the deck 104 and the transom 206.

The frame 130 includes a box-shaped framework, made from rectangular steel tubing sections 136-147 that are welded together. The frame 130 additionally includes a brace 150 made from rectangular steel tubing sections 151-154 welded together. However, different shapes and material and fastening means may be used without departing from this disclosure. Many of these will be apparent to ordinarily skilled artisans having the benefit of this disclosure.

The carriage 128 and frame 130 are interconnected as follows. The carriage section 134 includes a pivoting mechanism such as a rotatable bearing, axle, hinge, or other structure to provide pivoting attachment. In the illustrated example, a pair of pillow block bearings 158/702 are attached to the frame 130 by way of extensions 156-157 that are bolted or welded to the bearings 158/702 and bolted or welded to the frame 130. The pillow block bearings 158/702 are fastened to an axle (not shown) that runs through the carriage section 134 or attaches to the aft ends of the carriage sections 135/133.

This arrangement permits the forward end of the carriage 128 to swing up and aft during "extension" as the aft end of the carriage 128 pivots about the bearings 158/702. Similarly, the forward end of the carriage 128 may swing down and forward ("retraction") as the aft end of the carriage 128 pivots about the bearings 158/702. When the carriage 128 is fully retracted, the forward section 132 of the carriage 128 rests firmly upon the fully retracted hydraulic rams 164-165.

The hydraulic rams 164-165 provide a further connection of the carriage 128 to the frame 130, and serve as remotely controlled linearly actuated lifts. In the illustrated example, the hydraulic rams 164-165 are fastened to the carriage 128 and also to the brace 150. The hydraulic rams 164-165 control extension and retraction of the carriage 128. The hydraulic ram 164 is connected between brackets 168-169 that are welded, bolted, screwed, press-fit, or otherwise affixed to the carriage section 132 and brace section 152, respectively. Similarly, the hydraulic ram 165 is connected between a bracket 170 attached to the carriage section 132 and another bracket 802 (most clearly shown in FIG. 8) attached to the brace section 152.

The engine support structure 108 also includes catches 160-161 that are welded, bolted, screwed, press-fit, or otherwise firmly affixed to the frame 130. In the illustrated example, the catches 160-161 are welded to the brace section 154. The catches act as stops or guides for the carriage 128. In some implementations, more than 4,500 pounds of thrust is transferred to the carriage 128 from the propeller and engine. The catches 160-161 ensure that if one or both of the bearings 158/702 fail, the carriage 128 and engine will stay in the area where it was designed to safely operate.

Engine Support Structure—Detail in Extension

As an example of both engine support structures 108-109 in extended condition, FIGS. 9-13 illustrate the engine support structure 108 in greater detail. When the hydraulic rams 164-165 extend, their lower ends are still firmly held in place on the section 152 of the brace 150 by the brackets 169/802. Consequently, hydraulic ram extension manifests at the upper end of the hydraulic rams 164-165. Namely, the hydraulic rams 164-165, by virtue of their attachment to carriage section 132 by the brackets 168/170, cause the forward end of the carriage 128 to lift as the aft end of the carriage 128 pivots about the bearings 158/702.

Carriage Control System

FIG. 14 shows one example of a hydraulically driven carriage control system in greater detail. This system controls movement of the carriage 128 of the starboard side engine support structure 108. A similar hydraulically driven carriage control system (not shown) is implemented in regard to the carriage (not shown) of the port side engine support structure 109.

The hydraulic rams 164-165 are connected to one or more hydraulic pumps, exemplified by the pump 1403. In one example, the pump 1403 is implemented by a Mercury Marine trim pump which allows for trim up (extending) and trim down (retracting) of the rams 164-165 by operating an included D.C. motor (not shown) in forward and reverse directions.

The pump 1403 is coupled to a reservoir 1405. The pump 1403 is activated by an actuator 1407 such as a solenoid or relay. The actuator 1407 is driven by a control input 1410, or other words a "remote control", which is accessible by the operator. The control input 1410 in one example comprises two toggles, one for each engine, where each toggle has UP or EXTEND, DOWN or RETRACT, and NEUTRAL settings. In a different embodiment, there is one such toggle for both engines, and this solitary toggle operates two pairs of hydraulic rams so as to effect a similar magnitude and speed of movement. Apart from toggles, the control input 1410 may be implemented in different ways, such as one or more levers, switches, dials, sliders, touch screen, smart phone, table, or other mechanical or analog or digital control input.

The pump 1403 is connected to the hydraulic rams 165-165 by a hydraulic supply line 1413. To extend the carriage 128, the pump 1403 withdraws fluid from the reservoir 1405 and forces fluid into the hydraulic rams 164-165. To retract the carriage 128, this sequence occurs in reverse.

The trim system may further include trim indicators (not shown) positioned near the operator. Since the operator is focused on safely driving the boat, there is not always time to look back at the engines to determine where the engine is trimmed. A trim indicator (not shown) located at the helm allows the operator to monitor the trim state of the engines. The trim indicator may, for example, comprise a digital or analog gauge or screen or even a mechanical pointer or other device. In one instance, the trim indicator comprises an pointer that pivots up/down to indicate the amount of extended/retracted trim relative to a fixed reference line. The trim indicator may be driven by one or more sensors attached to any of the motor 1403, level of fluid in the reservoir 1405, one or both of the rams 164-165, part of the carriage 128, or other component whose position or other condition varies with trim state.

Installation

FIG. 15 depicts the engine support structure 108 with the gas turbine engine 112 installed thereon. The engine 112 is attached to a propeller 116 and an exhaust 1506. A shroud 1508 optionally encloses and protects engine components and controls that would otherwise be exposed to the elements. The shroud 1508 also provides a safety barrier for personnel operating or working on the airboat 100.

The engine 1502 is attached to the engine support structure 108 by a mounting fixture (not shown) comprised of a variety of steel support posts, flanges, mounting plates, bushings, and the like. The mounting fixture may be implemented in a variety of different ways, many of which will be apparent to those of ordinary skill in the art having the benefit of this disclosure.

Once installed, the engine 112 and propeller 116 define a thrust line 1510. The act of extending the carriage 128 tilts the thrust line 1510 in the direction 1512 and achieves an upward trim. Retracting the carriage 128 tilts the thrust line 1510 in the direction 1514 and achieves a downward trim.

In the illustrated twin engine embodiment, the second engine support structure 109 includes similar components as the engine support structure 108 as explained above. For example, the structure 109 includes a frame, carriage, brace, hydraulic rams, etc. The engine support structures 108-109 may be positioned to place the retracted-position thrust lines in parallel with the longitudinal axis of the hull or at a predetermined angle of incidence thereto. Alternatively, one or both retracted-position thrust lines may be canted to port or starboard to account for engine torque as appropriate to the rotation or counter-rotation of the engines 112-113 and propellers 116-117.

Some Alternatives

In the illustrated example, the forward end of the carriage 128 is movable and the aft end is fixed at the pivots 158/702. An alternative arrangement is possible where the forward end of the carriage 128 is pivotable and the aft end is movable. To implement this arrangement, the forward/aft ends of the disclosed engine support structure may be reversed. In another example, the carriage is supported above the frame and aft-mounted hydraulic rams in a normally extended position hold the carriage level. Here, by retracting the hydraulic rams, the aft end of the carriage is lowered, causing the engine thrust line to move in the direction 1512 of extension. Other variations may be implemented as well, these being obvious to those of ordinary skill in the art having the benefit of the present disclosure.

As illustrated, the brace 150 generally projects downward toward the deck 104 from the upper frame sections 141-142. The brace 150 serves to support the lower ends of the hydraulic rams 164-165. In a different embodiment, an alternative brace (not shown) is attached to one or more of the lower frame sections such as 137/143 and projects upward toward forward end of the carriage 128. In this example, and upward limit of the alternative brace would serve to support the lower ends of the hydraulic rams 164-165. In still another example, the brace may be attached to both upper 141-142 and lower 137/143 frame sections, with the lower attachment being made by a cross-member similar to the brace section 154. In still another example, an alternative brace may be built up from the deck 104. In this case, the brace may be solely attached to the deck 104, or attached to the deck 104 along with or additional support from frame structure as described previously. In still another example, hydraulic rams 164-165 of greater length may be used, so that the rams may be affixed by appropriate brackets directly to the deck 104 or a cross-member (not shown) between the frame sections 137/143 without involving any brace. Other variations may be implemented as well, these being obvious to those of ordinary skill in the art having the benefit of the present disclosure.

In another example, the engine support carriage is eliminated, and the engine is mounted to the frame, either directly or via mounting fixtures. Here, the aft end of the frame is pivotably attached to the deck, and the forward end of the frame movable under influence of hydraulic rams attached to the deck or intervening structure. If the rams are not tall enough to reach from the deck to the member 139, then a forward brace may be installed protruding downward from the member 139 to receive an upper end of the rams, or upward from the member 136 to receive a lower end of the rams. Other variations may be implemented as well, these being obvious to those of ordinary skill in the art having the benefit of the present disclosure.

OPERATION

Having described the structural features of the present disclosure, the operational aspects of the disclosure will now be described. Without any intended limitation, the operational aspects are described and illustrated in the context of the structure from FIGS. 1-15.

Figure 16:
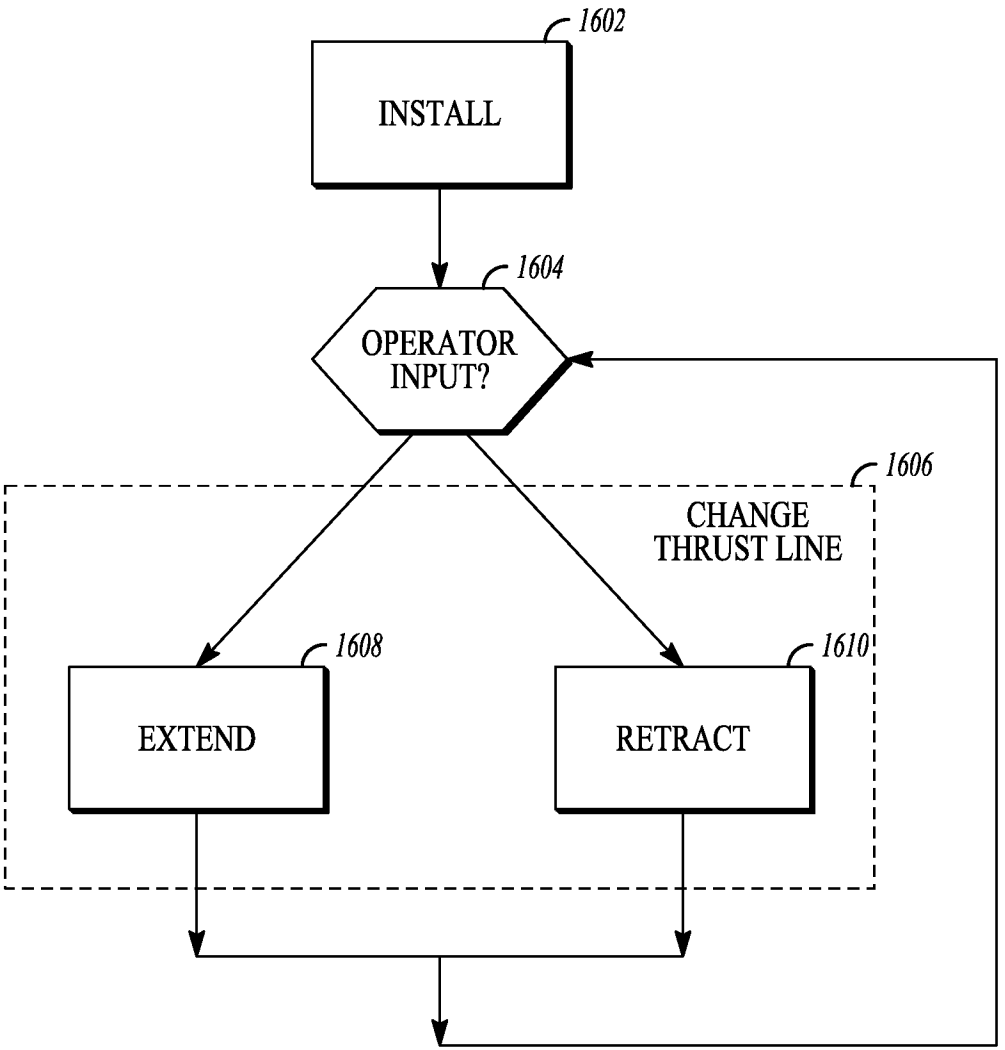
FIG. 16 is a flowchart illustrating a sequence to operate an airboat trim system.

One operational aspect of the disclosure is a method of adjusting trim of an airboat, as illustrated in FIG. 16 by operations 1600. This sequence 1600 is discussed in context of a twin engine airboat, but it is equally applicable to single engine embodiments. Operations concerning the engine support structures 108-109 are explained with regard to the structure 108 for ease of reference.

In step 1602, technicians install the engine support structures 108-109 to the hull 102. In one implementation, some or all of the frame sections 136-137/143-144 may be bolted to the deck 104. Also in step 1602, technicians install the hydraulically driven carriage control system, control inputs, engines, and propellers. After installation 1602, steps 1605-1606 describe ongoing operation of the engine support structures 108-109.

Step 1604 determines whether the remote control 1410 has received any direction from the operator. As mentioned above, this input may occur by operator activation of one or more toggles with EXTEND or UP, RETRACT or DOWN, and NEUTRAL settings. This disclosure also contemplates other control inputs 1410, such as one or more levers, switches, dials, sliders, touch screen, smart phone, table, or other mechanical or analog or digital control input.

Responsive to operator input, step 1606 changes the thrust line 1510 accordingly. Namely, step 1606 remotely causes the hydraulic rams 164-165 to selectively extend and/or retract. This is carried out by the following operations occurring in the starboard side engine support structure 108. In the port side engine support structure 109, similar operations occur in parallel, but for ease of explanation the starboard side operations are illustrated.

The following scenario takes place when the remote control 1410 signals extension, for example, when the operator flips a toggle to an UP position. This triggers the actuators 1407, causing the pump 1403 to pump fluid from the reservoir 1405 into the hydraulic rams 164-165. Under this influence, the hydraulic rams 164-165 elongate. When the hydraulic rams 164-165 elongate, their lower ends are still firmly held in place on the section 152 of the brace 150 by the brackets 169/802. Consequently, hydraulic ram extension manifests at the upper end of the hydraulic rams 164-165. Namely, the hydraulic rams 164-165, by virtue of their attachment to carriage section 132 by the brackets 168/170, cause the forward end of the carriage 128 to lift as the aft end of the carriage 128 pivots about the bearings 158/702. When the carriage 128 extends, the forward end of the engine 502 also lifts, causing the thrust line 1510 to pitch up as shown by 1512.

The following scenarios occurs when the control input 1410 signals retraction, for example when the operator flips a toggle to a DOWN position. This triggers the actuator 1407, causing the pump 1403 to remove fluid from the hydraulic rams 164-165 and discharge the fluid into the reservoir 1405. Under this influence, the hydraulic rams 164-165 shorten. When the hydraulic rams 164-165 shorten, with their lower ends still firmly held in place on the section 152 of the brace 150 by the brackets 169/802, the hydraulic ram shortening manifests at the upper end of the hydraulic rams 164-165. Namely, the hydraulic rams 164-165, by virtue of their attachment to carriage section 132 by the brackets 168/170, lower the forward end of the carriage 128 as the aft end of the carriage 128 pivots about the bearings 158/702. When the carriage 128 retracts, this lowers the forward end of the engine 1502, causing the thrust line 1510 to pitch down as shown by 1514.

Benefits & Advantages

The disclosed airboat trim system provides a number of advantages. For one, this trim system is effective even for airboats with high horsepower engines such as gas turbine engines. In fact, the disclosed trim system is effective and fully compatible with any conceivable engine, whether reciprocating or gas turbine or electric.

Another advantage is that, from the operator's perspective, this trim system retains the convenience of conventional systems based on trim tabs. The new system may be operated, for example, by using a convenient UP-DOWN-NEUTRAL toggle accessible to the operator. However, the present system avoids the disadvantages of conventional trim tab systems. For instance, it avoids awkward and easily damaged oversize trim tabs that would be required to be effective against high horsepower engines. Further, it omits trim tab actuation machinery, making the overall system more reliable.

Another benefit concerns the effectiveness of the disclosed trim system. Conventional airboats are typically set up with the thrust line parallel to the bottom of the boat. With the engine mounted high above the deck the resulting effect is the thrust tends to lift the stern of the boat which is where the majority of the weight is located. The curvature of the hull usually transfers the weight aft when running on plane, and therefore a transom mounted trim tab can be effective when it comes to trimming the boat at planning speeds. However, at slow water speeds, conventional trim tabs are ineffective because they simply do not have enough water flowing over them to effectuate any trimming action. In contrast, the disclosed trim system is effective regardless of water speed because it allows the operator to directly adjust engine thrust line. Furthermore, by changing the thrust line at the engine itself, this helps the airboat proceed over an obstacle such as a levee, and additionally helps the airboat transition from the water to an embankment. During such operations, conventional trim tabs are double ineffective because (1) these operations are often conducted at slow water speeds where conventional trim tabs would be ineffective, and (2) conventional trim tabs are designed to drive the bow downward at planing speeds, instead of achieving a bow lift. Using the disclosed trim system, the operator can change the direction of thrust and lift the bow of the boat, aiding in such transitions, even at slow water speeds.

OTHER EMBODIMENTS

While the foregoing disclosure shows a number of illustrative embodiments, it will be apparent to those skilled in the art that various changes and modifications can be made herein without departing from the scope of the invention as defined by the appended claims. Accordingly, the disclosed embodiment are representative of the subject matter which is broadly contemplated by the present invention, and the scope of the present invention fully encompasses other embodiments which may become obvious to those skilled in the art, and that the scope of the present invention is accordingly to be limited by nothing other than the appended claims.

All structural and functional equivalents to the elements of the above-described embodiments that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 USC 112, sixth paragraph, unless the element is expressly recited using the phrase "means for" or, in the case of a method claim, the phrase "step for."

Furthermore, although elements of the invention may be described or claimed in the singular, reference to an element in the singular is not intended to mean "one and only one" unless explicitly so stated, but shall mean "one or more". Additionally, ordinarily skilled artisans will recognize that operational sequences must be set forth in some specific order for the purpose of explanation and claiming, but the present invention contemplates various changes beyond such specific order.

This specification has been set forth with various headings and subheadings. These are included to enhance readability and ease the process of finding and referencing material in the specification. These heading and subheadings are not intended, and should not be used, to affect the interpretation of the claims or limit claim scope in any way.

The invention claimed is:

1. An adjustable trim system for an airboat that includes a hull having a deck and having a forward end and an aft end defining forward and aft directions respectively, the system comprising:

a frame mounted to the deck;

an engine support carriage including a forward end and an aft end;

at least one pivot connecting the frame and the engine support carriage at an aft end of the engine support carriage;

at least one lift supporting a forward end of the engine support carriage; and a remote control responsive to operator input to change a thrust line of an engine mounted to engine support carriage by selectively causing the at least one lift to extend and retract.

2. The system of claim 1, where the at least one lift comprises at least one hydraulic ram connected between the frame and a forward end of the engine support carriage.

3. The system of claim 1, where the at least one lift comprises at least one hydraulic ram connected between the deck and a forward end of the engine support carriage.

4. The system of claim 1, where a height of the frame is greater than a length of the at last one lift, and the frame includes a brace comprising a lowered section of the frame, and the connection of the at least one lift to the frame occurs at the brace.

5. The system of claim 1, where the frame includes catches adjacent to a forward end of the engine support carriage and positioned to prevent forward movement of the engine support carriage in the event of failure of any of the at least one pivot.

6. The system of claim 1, further comprising an airboat including the hull and the deck.

7. The system of claim 1, further comprising an engine mounted to the engine support carriage and a propeller coupled to the engine.

8. The system of claim 1, further comprising a second set of frame, engine support carriage, at least one pivot, and at least one lift to adjust trim of a second engine mounted to the engine support carriage of the second set.

9. The system of claim 8, where the second set includes a second remote control responsive to operator input to change a thrust line of the second engine.

10. The system of claim 1, where the at least one pivot comprises an axle coupled to the engine support carriage and pillow block bearings connected to the frame and rotatably housing the axle.

11. The system of claim 1, where the at least one lift is pivotably fastened to the engine support carriage at its forward end.

12. The system of claim 1, where connections of the at least one lift to the frame and the forward end of the engine support carriage are pivotable.

13. The system of claim 1, the engine support carriage further comprising at least one engine mounting fixture configured to secure an engine to the engine support carriage.

14. A trim system for an airboat having a hull and a deck, comprising:

an engine support carriage elevated from the deck and having a first end pivotably mounted to the deck via a rigid frame; and at least one remotely operated ram wherein each remotely operated ram includes a first end braced upon the deck or an intervening structure and a second end coupled to a free moving second end of the engine support carriage opposite the first end.

15. The system of claim 14, the first end of the engine support carriage comprising an aft end of the engine support carriage, and the second end of the engine support carriage comprising a forward end of the engine support carriage.

16. A method of adjusting trim on an airboat that includes a hull having a deck and having a forward end and an aft end defining forward and aft directions respectively, the method comprising operations of:

providing a frame mounted to the deck, an engine support carriage including a forward end and an aft end, at least one pivot connecting the frame and the engine support carriage at an aft end of the engine support carriage, and at least one lift supporting a forward end of the engine support carriage; and during operation of an engine mounted to the engine support carriage, selectively changing a thrust line of the engine by remotely causing the at least one lift to selectively extend and retract.

17. The method of claim 16, the operation of selectively changing a thrust line of the engine comprising the at least one lift exerting a force between the frame and the forward end of the engine support carriage.

18. The method of claim 16, the operation of selectively changing a thrust line of the engine comprising the at least one lift exerting a force between the deck and the forward end of the engine support carriage.

19. The method of claim 16, the operation of selectively changing a thrust line of the engine comprising the at least one lift exerting a force between a lowered section of the frame and the forward end of the engine support carriage.

20. The method of claim 16, the operations further comprising providing catches positioned to prevent forward movement of the engine support carriage in the event of failure of the at least one pivot.

21. The method of claim 16, the operations further comprising providing preventing forward movement of the engine support carriage in the event of failure of the at least one pivot.

22. The method of claim 16, the operations further comprising:

providing a second set of frame, engine support carriage, at least one pivot, and at least one lift; and adjusting trim of a second engine mounted to the engine support carriage of the second set.

23. A method of operating a trim system for an airboat having a hull and a deck, comprising operations of:

providing an engine support carriage elevated from the deck and having a first end pivotably mounted to the deck via a rigid frame, and providing at least one remotely operated ram where each said remotely operated ram includes a first end braced upon the deck or intervening structure and a second end coupled to a free moving second end of the engine support carriage opposite the first end; and during operation of an engine mounted to the engine support carriage, changing a thrust line of the engine by remotely varying a length of the at least one ram.

24. The system of claim 1, where each of said at least one lift comprises one or more linearly actuated lifts.

25. The system of claim 14, where each of said at least one remotely operated ram comprises one or more linearly actuated rams.

26. The method of claim 16, where the operations are performed such that each of said at least one lift comprises one or more linearly actuated lifts.

27. The method of claim 23, where the operations are performed such that each of said at least one remotely operated ram comprises one or more linearly actuated rams.

* * * * *